US011066901B2

(12) United States Patent
Arabskyy et al.

(10) Patent No.: US 11,066,901 B2
(45) Date of Patent: Jul. 20, 2021

(54) STORED-ENERGY PRESSURE ACTIVATED COMPLETION AND TESTING TOOLS AND METHODS OF USE

(71) Applicant: INTERRA ENERGY SERVICES LTD., Calgary (CA)

(72) Inventors: Serhiy Arabskyy, Beaumont (CA); Andrew Barabash, Edmonton (CA)

(73) Assignee: INTERRA ENERGY SERVICES LTD., Calgary (CA)

( * ) Notice: Subject to any disclaimer, the term of this patent is extended or adjusted under 35 U.S.C. 154(b) by 0 days.

(21) Appl. No.: 16/487,000

(22) PCT Filed: Feb. 21, 2018

(86) PCT No.: PCT/CA2018/000032

§ 371 (c)(1),
(2) Date: Aug. 19, 2019

(87) PCT Pub. No.: WO2018/152615

PCT Pub. Date: Aug. 30, 2018

(65) Prior Publication Data

US 2020/0024929 A1 Jan. 23, 2020

Related U.S. Application Data

(60) Provisional application No. 62/462,005, filed on Feb. 22, 2017.

(51) Int. Cl.
*E21B 34/10* (2006.01)
*E21B 34/14* (2006.01)
(Continued)

(52) U.S. Cl.
CPC ..... *E21B 34/102* (2013.01); *E21B 34/14* (2013.01); *E21B 43/14* (2013.01); *E21B 43/26* (2013.01);
(Continued)

(58) Field of Classification Search
CPC ..... E21B 34/14; E21B 47/117; E21B 43/14; E21B 43/26; E21B 2200/06
See application file for complete search history.

(56) References Cited

U.S. PATENT DOCUMENTS 4,846,272 A * 7/1989 Leggett ..... E21B 34/063 166/126
2014/0083708 A1* 3/2014 Beck ..... E21B 43/26 166/308.1
(Continued)

FOREIGN PATENT DOCUMENTS

CN 205117285 U 3/2016
WO 2014/035383 A1 3/2014

OTHER PUBLICATIONS

International Search Report issued by the Canadian Intellectual Property Office dated May 11, 2018 in connection with corresponding International PCT Patent Application No. PCT/CA2018/000032, 3 pages.
(Continued)

*Primary Examiner* — Tara Schimpf
*Assistant Examiner* — Dany E Akakpo

(57) ABSTRACT

Methods and apparatus of pressure activated completion tools for hydraulic fracturing and related processes are provided. In some embodiments, the hydraulic fracturing apparatuses for well testing and accessing subterranean formations can include a tubular body to be fluidly connected in-line with a completion string, a pressure storage mechanism to store pressure when exposed to hydraulic pressure, and a movable inner shift sleeve operable to slide along the inside of the tubular body from a first position to a second position when exposed to the stored pressure. The tubular body can have flow-port(s) that are blocked when the movable inner sleeve is in the first position and opened when
(Continued)

the movable inner sleeve slides to the second position. Uses of such apparatuses can include fracing, toe intervention, and pressure testing of wells.

22 Claims, 6 Drawing Sheets

(51) Int. Cl.
*E21B 43/14* (2006.01)
*E21B 43/26* (2006.01)
*E21B 47/117* (2012.01)

(52) U.S. Cl.
CPC ..... *E21B 47/117* (2020.05); *E21B 2200/06* (2020.05)

(56) References Cited

U.S. PATENT DOCUMENTS

2015/0034330 A1 2/2015 Merron et al.
2017/0175508 A1* 6/2017 Arabsky ..... E21B 34/103

OTHER PUBLICATIONS

Written Opinion of the International Searching Authority issued by the Canadian Intellectual Property Office dated May 11, 2018 in connection with corresponding International PCT Patent Application No. PCT/CA2018/000032, 3 pages.

* cited by examiner

STORED-ENERGY PRESSURE ACTIVATED COMPLETION AND TESTING TOOLS AND METHODS OF USE

CROSS-REFERENCE TO RELATED APPLICATION

The present application claims priority to U.S. Provisional Patent Application Ser. No. 62/462,005 filed Feb. 22, 2017, the entire contents of which is hereby expressly incorporated herein by reference.

STATEMENT REGARDING FEDERALLY SPONSORED RESEARCH OR DEVELOPMENT

Not applicable.

FIELD

The present disclosure is related to the field of methods and apparatuses of completion and testing tools, in particular, methods and apparatuses of pressure activated completion and testing tools for hydraulic fracturing.

BACKGROUND

The technique of hydraulic fracturing (commonly referred to as "fracing" or "fracking") is used to increase or restore the rate at which fluids, such as oil, gas or water, can be produced from a reservoir or formation, including unconventional reservoirs such as shale rock or coal beds. Fracing is a process that results in the creation of fractures in rocks. The most important industrial use is in stimulating oil and gas wells where the fracturing is done from a wellbore drilled into reservoir rock formations to increase the rate and ultimate recovery of oil and natural gas.

It is becoming more common to require pressure testing of downhole fracing systems and liners to ensure that there are no unwanted leaks. Current methods for downhole pressure safety testing are inadequate, costly, and unreliable.

Tools that operate and rely on the annular (formation) pressure tend to be unreliable. Cement, debris, as well as unpredictable wellbore pressures and temperatures can cause the tool to not function as planned. Attempts have been made to address these issues by trying to delay the opening of the tool as well as using dissolvable technology to try to time a pressure test. These technologies are susceptible to failure because of the difficulty in controlling the downhole conditions.

Safer, more reliable and cost-effective fracing and testing methods and systems are quickly becoming sought after technology by oil and natural gas companies. It is, therefore, desirable to provide an apparatus and method for hydraulic fracturing and testing that can overcome the shortcomings of the prior art and provide a greater degree of reliability.

SUMMARY

Methods and apparatuses of pressure activated completion tools for hydraulic fracturing and related processes are provided. In some embodiments, the hydraulic fracturing apparatuses for well testing and accessing subterranean formations can include a tubular body to be fluidly connected in-line with a completion string, a pressure storage mechanism to store pressure when exposed to hydraulic pressure, and a movable inner shift sleeve operable to slide along the inside of the tubular body from a first position to a second position when exposed to the stored pressure. The tubular body can have flow-port(s) that are blocked when the movable inner sleeve is in the first position and opened when the movable inner sleeve slides to the second position. Uses of such apparatuses can include fracing, toe intervention, and pressure testing of wells.

In some embodiments, an internal charged fluid, such as a compressible gas, can be used to mechanically operate the apparatus, where the charged fluid can operate like a spring. The internal charged fluid can allow the tool to be self-sufficient and activate and operate without requirements of external forces from the formation to activate. In some embodiments, the pressure used to pressure test the well can be stored and used later within the apparatus to initiate the activation/opening of the apparatus when it is needed. Accordingly, the reliance of the apparatus on outside forces to accomplish the opening function of the apparatus is removed. By doing so, the reliability of the tool can be increased.

In some embodiments, the apparatus can be configured to hold up to a pressure test of up to a predetermined burst pressure rating for one or more pressure tests. An advantage of the apparatus described herein is that it is able to open at a lower pressure as compared to prior art designs. A further advantage of the apparatus is that it can provide a less complex and less expensive apparatus.

Broadly stated, in some embodiments, a hydraulic fracturing apparatus is provided for pressure testing a liner or casing of a hydrocarbon well and establishing communication between the casing and a formation after the pressure test, the apparatus comprising: a tubular body configured to be fluidly connected in-line with a production casing having an upstream and a downstream; a fluid compartment for receiving a compressible fluid within the tubular body; a movable inner piston within the tubular body operable to slide along the inside of the tubular body from a first piston position to a second piston position when exposed to hydraulic pressure, wherein in operation the compressible fluid is compressed and stores energy in response to the movement of the inner piston toward the second position; a movable inner sleeve within the inner piston operable to slide along the inside of the tubular body from a first sleeve position to a second sleeve position when exposed to stored energy from the inner piston; a first locking mechanism operable to lock the inner piston to the inner sleeve such that when the inner piston moves from the second piston position back to the first piston position, the inner sleeve moves the first sleeve position toward the second sleeve position; and at least one flow-port in the tubular body that is blocked when the movable inner sleeve is in the first sleeve position and opened when the movable inner sleeve slides towards the second sleeve position.

In some embodiments, the apparatus can further comprise wherein the movable inner piston abuts the fluid compartment, wherein the compressible fluid comprises a gas, wherein the gas is selected from the group consisting of nitrogen, argon, neon, helium, and a combination thereof, a second locking mechanism operable to lock the movable inner sleeve at a predetermined position within the tubular body, wherein the predetermined position of the movable inner sleeve is the second position, wherein the second locking mechanism comprises a ratchet and a corresponding profile, wherein the first locking mechanism comprises a ratchet and a corresponding profile, wherein the at least one flow-port is configured to receive a shield, wherein the shield is an aluminum shield, and/or wherein the at least one flow-port has a diameter that is choked in order to limit fluid flow out of the flow-port or to create a jetting effect.

Broadly stated, in some embodiments, a method is provided for pressure testing a well or a portion thereof using an apparatus as described herein, the method comprising: applying a predetermined level of fluid pressure required to pressure test a well to the apparatus; activating the inner piston; and compressing the compressible fluid to store pressure from the fluid pressure applied.

In further embodiments, there is provided a method of testing and hydraulically fracturing a formation in a well using an apparatus as described herein, the method comprising: applying a predetermined level of fluid pressure required to pressure test a well to the apparatus; activating the inner piston; compressing the compressible fluid to store pressure from the fluid pressure applied; locking the inner piston to the inner sleeve; bleeding off the pressure from the apparatus; shifting the inner sleeve using stored pressure from the compressible fluid; and opening the at least one flow-port.

In some embodiments, the method can further comprise resupplying pressurized fracture fluid to the apparatus; and allowing the pressurized fracture fluid to flow through the flow-port to contact the formation, locking the inner sleeve in the second sleeve position, and/or supplying fracture fluid to the apparatus and fracturing a formation in the well.

In additional embodiments, there is provided a method of testing and hydraulically fracturing a formation in a well having a completion string proximate to the formation, the completion string having a plurality of production zones, the method comprising:

a) separating one production zone with the apparatus from the other production zones;
b) applying a predetermined level of fluid pressure to the apparatus in the separated production zone required to pressure test the production zone;
c) activating the inner piston;
d) compressing the compressible fluid to store pressure from the fluid pressure applied;
e) locking the inner piston to the inner sleeve;
f) bleeding off the pressure from the apparatus;
g) shifting the inner sleeve using stored pressure from the compressible fluid; and
h) opening the at least one flow-port. The method may further comprise: i) resupplying pressurized fracture fluid to the apparatus; j) allowing the pressurized fracture fluid to flow through the flow-port to contact the formation proximate to the formation; k) locking the inner sleeve in the second sleeve position; l) supplying fracture fluid to the apparatus and fracturing the formation proximate to the production zone; selecting an additional production zone comprising the apparatus and separating the additional production zone with the apparatus from the other production zones and repeating steps c)-l); and where selecting an additional production zone comprising the apparatus and separating the additional production zone with the apparatus from the other production zones and repeating steps c)-l) is performed a plurality of times

DETAILED DESCRIPTION

An apparatus and method for hydraulic testing and fracturing are provided herein.

Figure 1A:
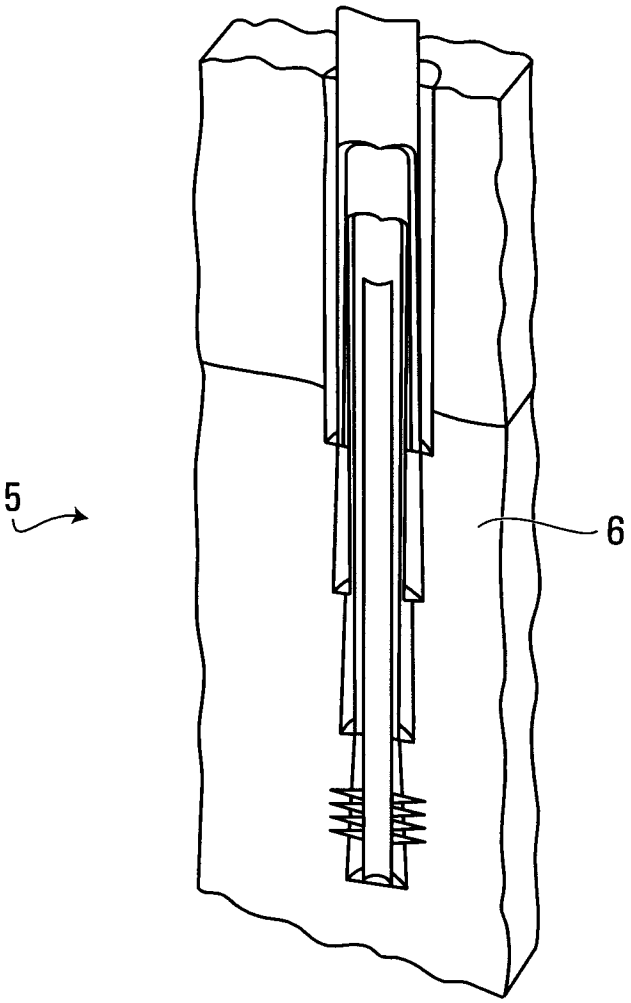
FIG. 1A is a diagram of a side elevation view of a well, depicting an embodiment of casing run into a well and cemented into the ground/formation.
Figure 1B:
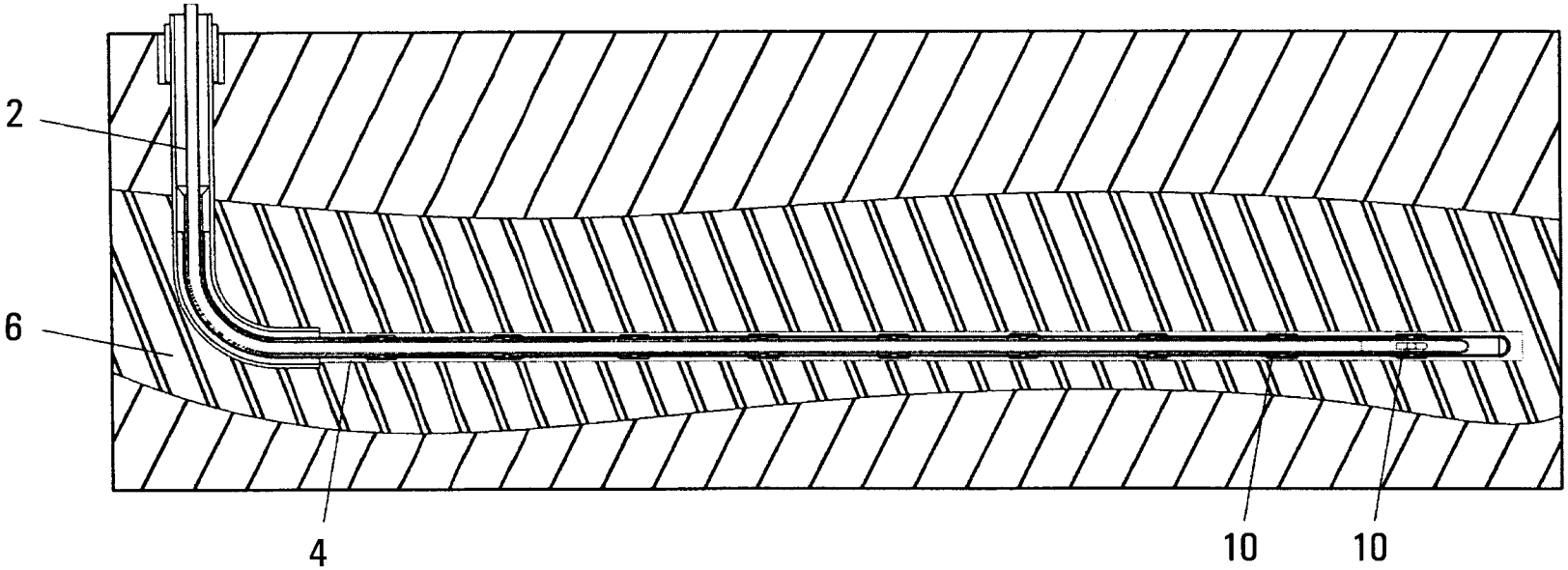
FIG. 1B is a diagram of a side elevation view of a well, depicting an embodiment of an apparatus for hydraulic fracing or testing where the formation and well head are visible.
Figure 1C:
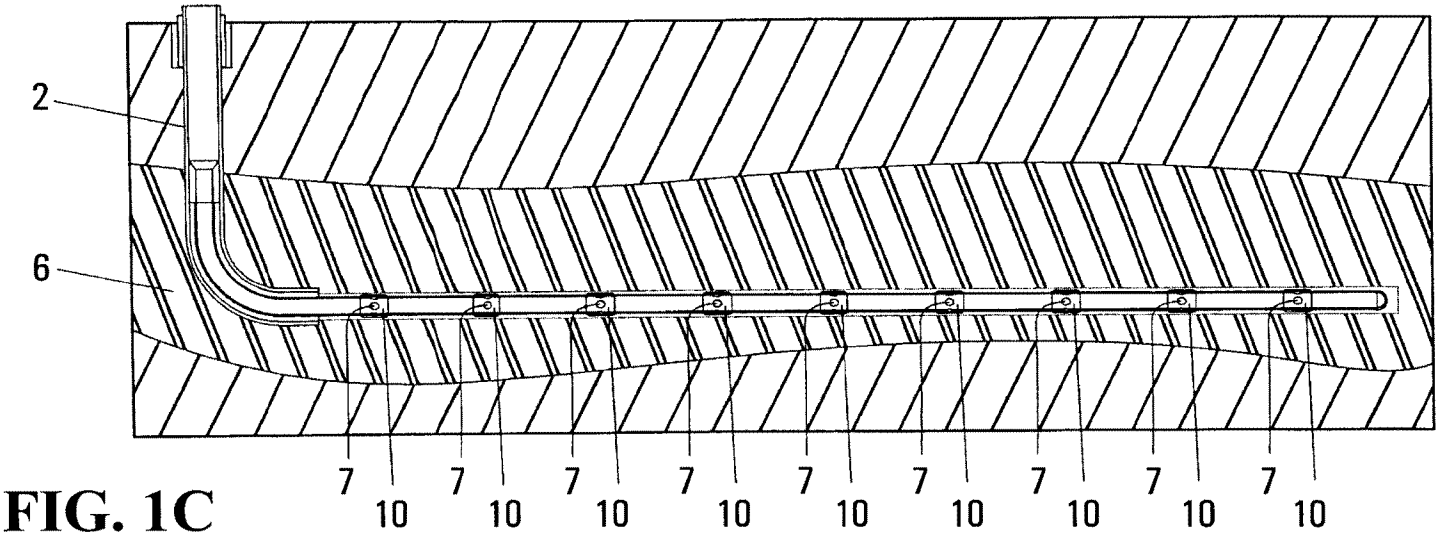
FIGS. 1C and 1D are diagrams of a side elevation view of a well, depicting embodiments of an apparatus for hydraulic fracing or testing along a completion string.
Figure 1D:
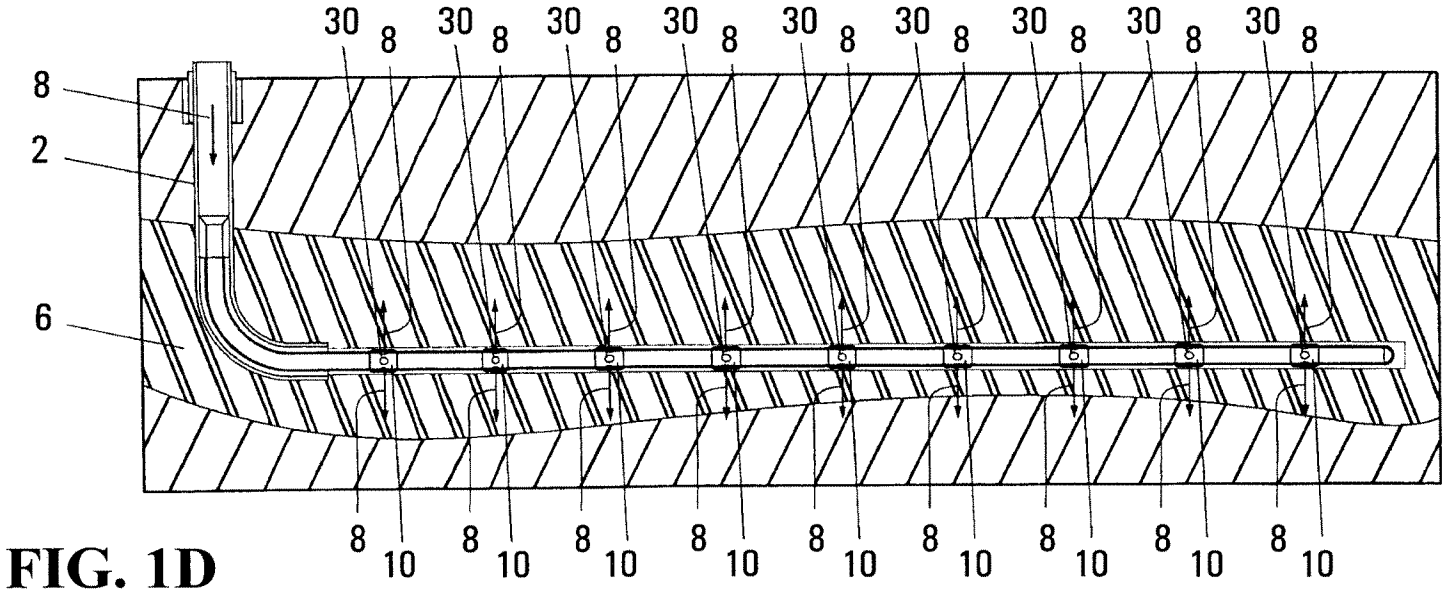

Referring to FIGS. 1B, 1C, and 1D, a well 2 is shown from a side elevation view where service/completion string 4 is downhole and proximate formation 6. Fracing fluid 8 can be pumped downhole through service/completion string 4 to tool/apparatus 10. Apparatus 10 can then release pressurized fracing fluid 8 through burst plug 7 (which may be used to initially block fluid flow) to fracture formation 6 or well 2. It would be understood that burst plug 7 could also be called a burst disk or burst insert.

Referring to FIG. 1A, casing is shown run into a well and cemented into the ground/formation. The final casing is the production casing 5 which is run to produce oil. The apparatus as described herein is configured to be used on the end of production casing 5, known as the toe, and it may also be used at other locations of production casing 5. Once the casing has been run-in and cemented in place, the casing is tested to see that it holds pressure. To properly test the casing the pressure is taken to near its maximum rating to verify it holds. Once the test is complete, the casing is then opened for production.

Figure 2:
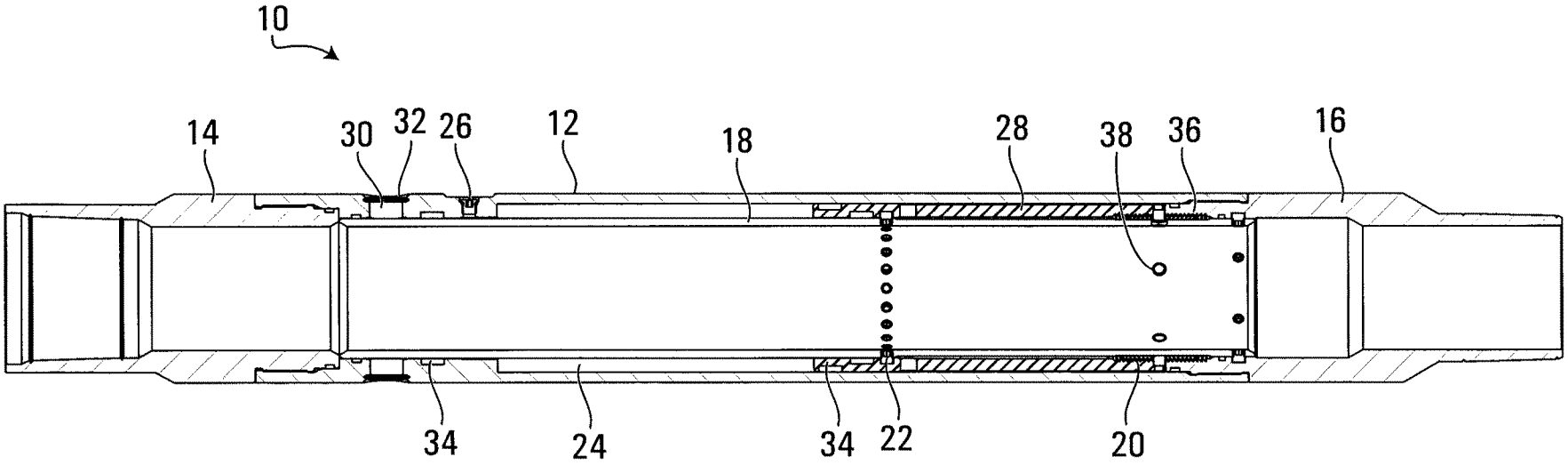
FIG. 2 is a cross-sectional view of an embodiment of an apparatus for hydraulic well testing or fracing in a run-in position.

Referring now to FIG. 2, apparatus 10 is shown comprising a main body (outer housing) 12 with a top connector (upper housing) 14 and a bottom connector (lower housing) 16. Top and bottom as used herein are relative terms and it would be understood by one skilled in the art that the orientation could be inverted without detracting from the function of the apparatus 10. Similarly, top and bottom can be interchanged with terms such as left and right, or upstream and downstream, as required by the context of apparatus 10. The main body 12 can be tubular as to allow a fluid connection with production casing 5 and/or a service/completion string 4 and allow fracing (or other) fluid 8 to pass through main body 12.

Upper housing 14 can connect the upper end of apparatus 10 to production casing 5. The end of upper housing 14 can be changed to mate with the casing thread as required. Upper housing 14 can limit and hold inner sleeve (shift sleeve) 18 from moving out of the apparatus 10.

Lower housing 16 can connect the lower end of apparatus 10 to production casing 5. As above, the end of lower housing 16 can be changed to mate with the casing thread as required. Lower housing 16 can also limit and hold inner sleeve (shift sleeve) 18 from moving out of the apparatus 10. In some embodiments, lower housing 16 can include a locking mechanism 20, such as a ratchet assembly, that can limit shift sleeve 18 from moving upwards yet allows shift sleeve 18 to move down. In some embodiments, lower housing 16 can include shear screws 22 to hold shift sleeve 18 in a predetermined position until applied pressure shears the shear screws 22 to allow shift sleeve 18 to move within apparatus 10. In some embodiments, apparatus 10 can also include grooves in shift sleeve 18 to receive shear screws 22.

Outer housing 12 can hold a charged, or chargeable, fluid in apparatus 10. In some embodiments, the fluid can be held in fluid compartment 24 and can be filled, prior to operation, via port 26 to a required value. The pressure value of the pressurized fluid can range from the value of the head of the fluid in the casing to the limit of the casing. The value can often coincide with the pressure created from the fluid head of the casing. Outer housing 12 can connect upper housing 14 and lower housing 16 and can have a polished inner diameter (ID) which can carry piston 28 that strokes during operation. Seals 34 in seal grooves on outer housing 12 and piston 28 can create sealed boundaries for fluid compartment 24.

Outer housing 12 can also include at least one flow-port 30, that once apparatus 10 has operated, can allow fluid communication between the casing ID and the formation 6. In some embodiments, the diameter of flow-port(s) 30 can be choked in order to limit fluid flow out of flow-port(s) 30 or to create a jetting effect.

In some embodiments, flow-port(s) 30 can also be configured to receive shield(s) 32 as are known in the art. These embodiments can be used in situations such as non-cemented environments, or early stage operations where there is little debris in the environment surrounding apparatus 10. In these situations, shield(s) (debris barriers) 32 can be sufficient to block fluid and debris from entering the interior of apparatus 10. In some embodiments, shield(s) 32 can be a thin aluminum shield, although it would be understood that other suitable materials could be used. In some embodiments, shield(s) 32 can be positioned towards the exterior of the opening of flow-port(s) 30. In some embodiments, a void can be defined therewithin, for example, the void can be defined between the shield(s) 32 and shift sleeve 18. Shield(s) 32 can be vented to provide a means of equalizing pressure between the void and an annulus formed between the tubular member and the wellbore. In some embodiments, the void can be filed with a substance (such as a gel or grease) for resisting entry of a wellbore fluid (such as cement) thereinto through the hole. Shield(s) 32 can prevent the gel or grease in the void from escaping. In some embodiments, burst plug 7 can also be used in flow-port(s) 30.

Balancing piston 28 and associated seals 34 can hold the compressible fluid inside apparatus 10. Piston 28 can move when pressure rises on the inside of the production casing 5. Communication holes 38 in shift sleeve 18 can allow fluid communication to the back of piston 28. In some embodiments, communication holes 38 can include screens that can limit fluid flow until and allow a barrier fluid to be held there until piston 28 begins to move. A pressure differential to move piston 28 can occur in at least two ways. First, through the fluid head which is usually compensated; the fluids can be of different weights/densities. The second way is when pressure is created on surface for a given function, for example, a required pressure test.

Piston 28 can include shear screws 22 to be received by corresponding screw holes in the outer diameter (OD) of shift sleeve 18, where screws 22 can be configured to shear at a predetermined desired pressure that will determine the required pressure change before movement of piston 28 can occur. In some embodiments, the ID of piston 28 can carry a locking mechanism 20, such as a ratchet lock, that can lock it in position relative to shift sleeve 18 once testing pressure has occurred.

Shift sleeve 18 can include features such as those mentioned above. The OD of shift sleeve 18 can form a wall of fluid compartment 24 and helps to contain the compressible fluid in the apparatus 10. Shift sleeve 18 can include shear screws 22 that can set when the piston will start moving as well as shear screws 22 that determine when the shift sleeve 18 itself will start moving open. Shift sleeve 18 can include ratchet lock 20 that can hold the piston against it in one direction, as well as the second ratchet lock 36 that can keep open the flow-port(s) 30 for communication.

Shift sleeve 18 can be slidable to, and between, at least two positions, a first position where flow port(s) 30 are blocked and a second position where flow port(s) 30 are opened/exposed to allow fluid communication (for the flow of pressurized frac fluid, as an example) between the inside of the tubular apparatus 10 and the external of apparatus 10.

In some embodiments, first locking mechanism 20 can comprise a resettable jay mechanism, such mechanism can allow to pressure test a well a predetermined number of times; each time apparatus 10 can store and release the pressure/energy without opening flow port(s) 30. Once a predetermined amount of cycles has ended, locking mechanism 20 would be allowed to engage and lock the inner piston 28 to the inner shift sleeve 18, on this final cycle, flow port(s) 30 can be opened. Many variations of apparatus 10 are possible, all leading towards storing the pressure and using it to open flow port(s) 30 of apparatus 10 upon bleed down.

Figure 3:
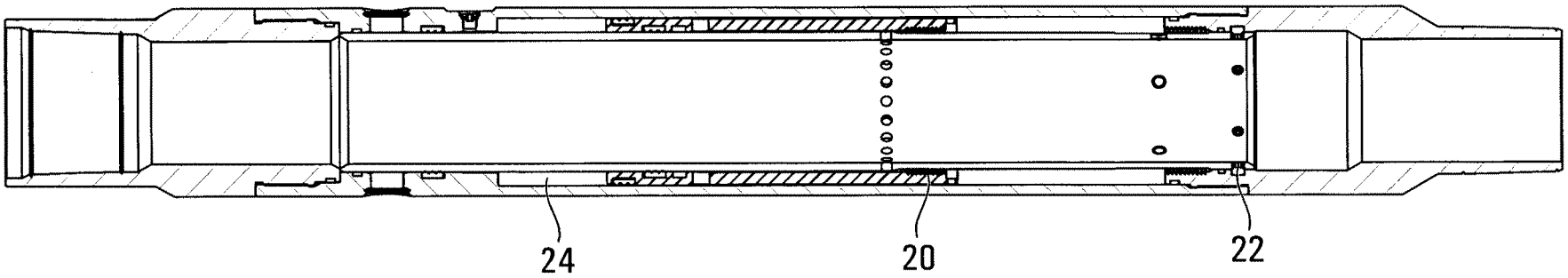
FIG. 3 is a cross-sectional view of the embodiment of FIG. 2 in a casing pressure test position.
Figure 4:
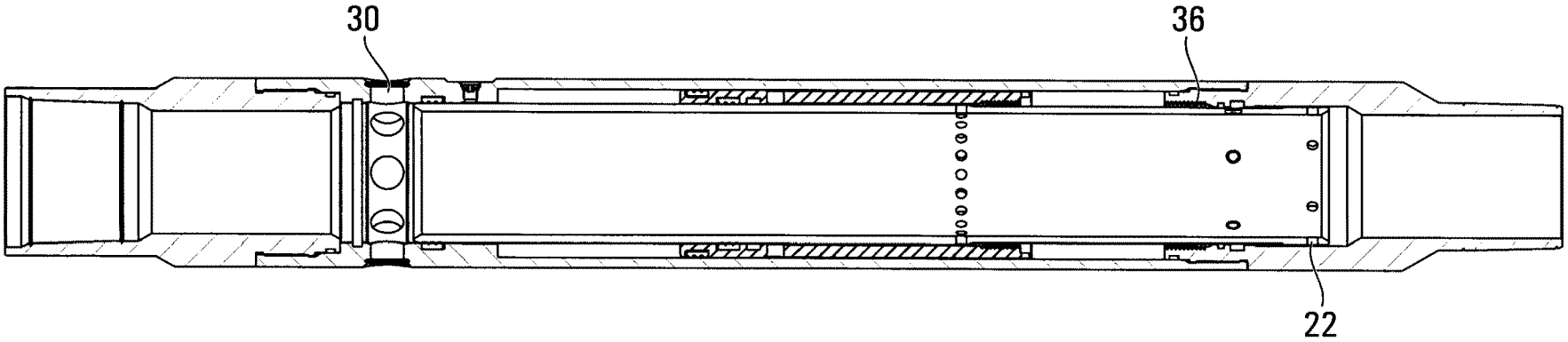
FIG. 4 is a cross-sectional view of the embodiment of FIG. 2 in a bleed down to open position.

In operation, and referring to FIGS. 2 to 4, apparatus 10 can use inner sleeve 18 to cover otherwise unblocked flow-port(s) 30 and to shift inner sleeve 18 and expose multiple flow-port(s) 30 simultaneously.

The pressure activation sequence of apparatus 10 positions is depicted in FIGS. 2, 3, and 4. The operations of apparatus 10 are as follows:

Referring to FIG. 2 (Run-in or "as run" position):

Apparatus 10 can be pre-charged to a required pressure. The pre-charge can occur to the left/upstream of piston 28. Apparatus 10 can be pre-charged using a compressible fluid such as an inert gas (nitrogen, argon, neon, helium) in fluid compartment 24 and can be taken to a pressure that is equal to or above the wellbore pressure. The pre-charge has the added advantage of balancing the pressure across the seals 34 for fluid compartment 24, making it less likely to leak over time. The pre-charge can also help to decrease the amount of travel that piston 28 must compensate for the test pressure. The test pressure, depending on production casing 5 type and size can reach pressures of 10,000 psi and higher. As gas compression is not linear, compression of the gas to store the pressure can takes a lot less travel of piston 28 the higher the pre-charge is.

Shear screws 22 can also be used to prevent piston 28 from moving prematurely. Such piston shear screws 22 can prevent any undesired movement in case of a pressure spike in the production casing 5 that was not intentional. Travel of piston 28 can be prevented from occurring until there is a controlled minimum amount of pressure increase which would usually denote a pressure test.

Referring to FIG. 3 (Casing Pressure Test Position):

Once a pressure test is initiated, piston 28 will not start moving until the shear-screw shear failure threshold has been met. Once the threshold is met and shear screws 22 are sheared, piston 28 can begin to move compressing the compressible fluid in fluid compartment 24. Piston 28 can travel upstream within apparatus 10, compressing the fluid, while ratchet 20 keeps piston 28 from traveling in the opposite direction should the pressure fluctuate. Once the casing test pressure is met, it can be maintained for as-long as required.

Referring to FIG. 4 (Bleed Down to Open Position):

Once the casing test has concluded, the pressure can be brought down. Because of ratchet lock 20, the piston 28 and shift sleeve 18 will be locked and will move as one. As the casing pressure drops, the pressure across the piston 28 and shift sleeve 18 combination will become unbalanced. To compensate, the piston 28 and shift sleeve 18 combination will move back downstream in the other direction. Note that in some embodiments, shear screws 22 (shear pins) can also be used in connecting shift sleeve 18 and lower housing 16. These second shear pins can prevent movement of shift sleeve 18 until a minimum amount of pressure drop has occurred to begin having the piston 28 and shift sleeve 18 combination move. The second shear pins can be used as there may be a fluctuation in pressure during the test. Once the pressure drop is sufficient, the shear screws 22 can shear and the piston 28 and shift sleeve 18 combination can move. Once the piston 28 and shift sleeve 18 combination moves to a certain point, flow port(s) 30 will be unobstructed and open, allowing communication from the inside of the production casing 5 to the formation 6. Production can begin. Pressurized fracture fluid 8 is able to flow through the opened flow-port 30 to exit apparatus 10 and to contact the formation 6 in order to fracture the formation 6 in the well 2.

In some embodiments, a second ratchet lock assembly 36 can be used to lock shift sleeve 18 itself in an open position to lower housing 16. This than prevents the piston 28 and shift sleeve 18 combination from moving back and closing the flow port(s) 30. It ensures apparatus 10 remains open.

In some embodiments, an operator can place apparatus 10 at the toe (end) of a service/completion string 4 in a well 2. In these cases, apparatus 10 can be activated by pressuring up a whole well liner (i.e. not by straddle packer, as would be understood by one skilled in the art) and apparatus 10 can act as an initiator to get fluid flow started and can also act as a first stage of fracturing operations. Once activated, fluid flow can be established in order to perform operations that need to use flowing fluid (for example, pump down plugs or perforating guns).

In other embodiments, an operator may place apparatus 10 at the toe (end) of a service/completion string 4 in a well and at an additional production zone or a plurality of apparatus 10 in a plurality of production zones of the service/completion string 4 as shown in FIG. 1D in order to test and/or hydraulically frac the formation 6 at multiple locations proximate to the production zones. In this embodiment, the service completion string 4 comprises a plurality of productions zones with at least one of the production zones comprising apparatus 10. The particular production zone (zone of interest) comprising apparatus 10 may then be separated from the other production zones along the service/completion string 4 using known techniques, such as, but not limited to, packing elements like a swellable packer, hydraulically-set packer or mechanically-set packer. Apparatus 10 may be operated in the run-in position, casing pressure test position and bleed down to open position as described above to pressure test the production zone and/or hydraulically frac the formation adjacent to the production zone.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A hydraulic fracturing apparatus for pressure testing a liner or casing of a hydrocarbon well and establishing communication between the casing and a formation after the pressure test, the apparatus comprising:

a tubular body configured to be fluidly connected in-line with a production casing having an upstream and a downstream;

a fluid compartment for receiving a compressible fluid within the tubular body;

a movable inner piston within the tubular body operable to slide along the inside of the tubular body from a first piston position to a second piston position when exposed to hydraulic pressure, wherein in operation the compressible fluid is compressed and stores energy in response to the movement of the inner piston toward the second position;

a movable inner sleeve within the inner piston that is operable to slide along the inside of the tubular body from a first sleeve position to a second sleeve position when exposed to stored energy from the inner piston;

a first locking mechanism operable to lock the inner piston to the inner sleeve such that when the inner piston moves from the second piston position back to the first piston position, the inner sleeve moves from the first sleeve position toward the second sleeve position; and at least one flow-port in the tubular body that is blocked when the movable inner sleeve is in the first sleeve position and opened when the movable inner sleeve slides towards the second sleeve position.

2. The apparatus of claim 1, wherein the movable inner piston abuts the fluid compartment.

3. The apparatus of claim 1, wherein the compressible fluid comprises a gas.

4. The apparatus of claim 3, wherein the gas is selected from the group consisting of nitrogen, argon, neon, helium, and a combination thereof.

5. The apparatus of claim 1, further comprising a second locking mechanism operable to lock the movable inner sleeve at a predetermined position within the tubular body.

6. The apparatus of claim 5, wherein the predetermined position of the movable inner sleeve is the second position.

7. The apparatus of claim 5 wherein the second locking mechanism comprises a ratchet and a corresponding profile.

8. The apparatus of claim 1, wherein the first locking mechanism comprises a ratchet and a corresponding profile.

9. The apparatus of claim 1, wherein the at least one flow-port is configured to receive a shield.

10. The apparatus of claim 9, wherein the shield is an aluminum shield.

11. The apparatus of claim 1, wherein the at least one flow-port has a diameter that is choked in order to limit fluid flow out of the flow-port or to create a jetting effect.

12. A method of pressure testing a well or a portion thereof using the apparatus of claim 1, the method comprising:

applying a predetermined level of fluid pressure required to pressure test a well to the apparatus;

activating the inner piston; and compressing the compressible fluid to store pressure from the fluid pressure applied.

13. A method of testing and hydraulically fracturing a formation in a well using the apparatus of claim 1, the method comprising:

applying a predetermined level of fluid pressure required to pressure test a well to the apparatus;

activating the inner piston;

compressing the compressible fluid to store pressure from the fluid pressure applied;

locking the inner piston to the inner sleeve;

bleeding off the pressure from the apparatus;

shifting the inner sleeve using stored pressure from the compressible fluid; and opening the at least one flow-port.

14. The method of claim 13 further comprising:

resupplying pressurized fracture fluid to the apparatus; and allowing the pressurized fracture fluid to flow through the flow-port to contact the formation.

15. The method of claim 13 further comprising:

locking the inner sleeve in the second sleeve position.

16. The method of claim 13, further comprising supplying fracture fluid to the apparatus and fracturing the formation in the well.

17. A method of testing and hydraulically fracturing a formation in a well having a completion string proximate to the formation, the completion string having a plurality of production zones, the method comprising:

a) separating one production zone comprising an apparatus of claim 1 from the other production zones;

b) applying a predetermined level of fluid pressure to the apparatus in the separated production zone required to pressure test the production zone;

c) activating the inner piston;

d) compressing the compressible fluid to store pressure from the fluid pressure applied;

e) locking the inner piston to the inner sleeve;

f) bleeding off the pressure from the apparatus;

g) shifting the inner sleeve using stored pressure from the compressible fluid; and h) opening the at least one flow-port.

18. The method of claim 17 further comprising:

i) resupplying pressurized fracture fluid to the apparatus; and j) allowing the pressurized fracture fluid to flow through the flow-port to contact the formation proximate to the production zone.

19. The method of claim 17 further comprising:

k) locking the inner sleeve in the second sleeve position.

20. The method of claim 19, further comprising:

l) supplying fracture fluid to the apparatus and fracturing the formation proximate to the production zone.

21. The method of claim 20 further comprising selecting an additional production zone comprising the apparatus and separating the additional production zone with the apparatus from the other production zones and repeating steps c)-l).

22. The method of claim 21 wherein selecting an additional production zone comprising the apparatus and separating the additional production zone with the apparatus from the other production zones and repeating steps c)-l) is performed a plurality of times.

* * * * *